United States Patent [19]

Tupper et al.

[11] 4,265,179

[45] May 5, 1981

[54] LOAD-TRANSFER DEVICE

[75] Inventors: Alan W. Tupper, The Weavers House, Castle Combe, Wiltshire, SN14 7HX, England; Peter R. Flux, Calne, England

[73] Assignee: Alan William Tupper, Wiltshire, England

[21] Appl. No.: 21,967

[22] Filed: Mar. 19, 1979

[30] Foreign Application Priority Data

Mar. 30, 1978 [GB] United Kingdom ..... 12342/78

[51] Int. Cl.[3] ..... B61B 12/02

[52] U.S. Cl. ..... 104/182; 104/115; 191/76

[58] Field of Search ..... 104/182, 112, 115, 116, 104/180, 185, 186, 198, 199; 191/76

[56] References Cited

U.S. PATENT DOCUMENTS

| | | | |
|---|---|---|---|
| 364,669 | 6/1887 | Prentice | 104/182 |
| 904,119 | 11/1908 | Downs | 104/182 |
| 1,106,471 | 8/1914 | Opsal | 104/182 |
| 1,429,007 | 9/1922 | Wilson | 104/182 |
| 1,501,748 | 7/1924 | Chapman et al. | 104/182 |
| 3,922,972 | 12/1975 | Junes | 104/112 X |

FOREIGN PATENT DOCUMENTS

| | | | |
|---|---|---|---|
| 504718 | 12/1954 | Italy | 104/182 |
| 239474 | 1/1946 | Switzerland | 104/115 |
| 427886 | 7/1967 | Switzerland | 104/182 |

*Primary Examiner*—Randolph A. Reese

*Attorney, Agent, or Firm*—Scully, Scott, Murphy & Presser

[57] ABSTRACT

A load transfer device is disclosed which includes a rotatable wheel which is formed with several recesses in its periphery to receive a load bearing element. The load bearing element extends transversely to the plane of the wheel and cooperates in use with the load transfer device, the recesses being evenly spaced around the wheel and adjacent recesses being separated by a projecting part of the wheel.

at least one guide member is supported at a peripheral part of the wheel, the wheel and guide member having cooperating relatively rotatable surfaces to allow the wheel to rotate about its axis relative to the guide member with the load bearing element being received, guided and passed in at least one of the recesses while being located with respect to the wheel by the guide member.

16 Claims, 16 Drawing Figures

Fig.8A.
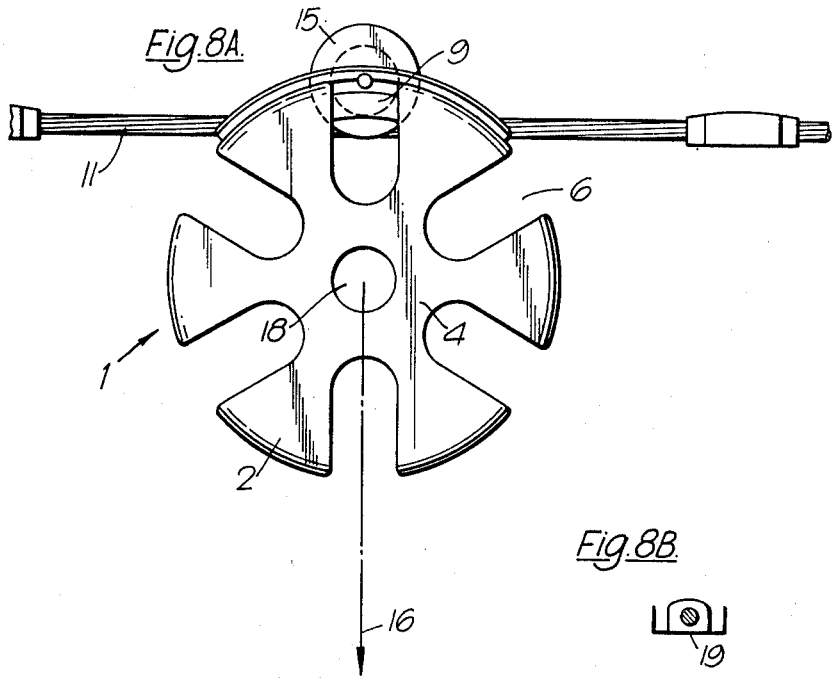
Fig.8B.
Fig.9.
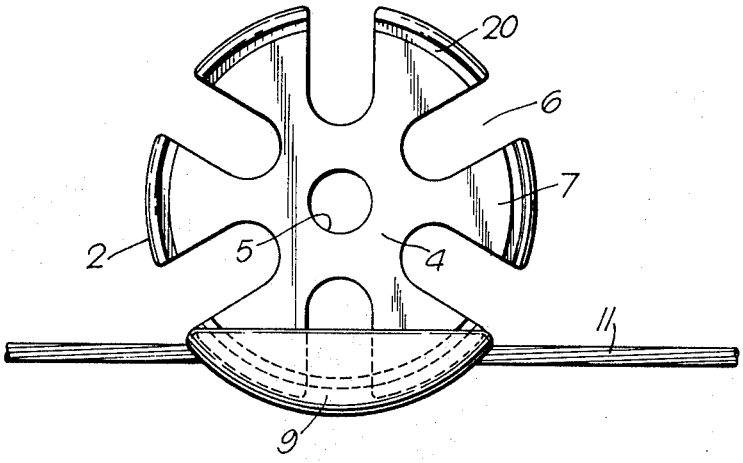

LOAD-TRANSFER DEVICE

BACKGROUND OF THE INVENTION

This invention relates to a device, hereinafter called a load transfer device, for enabling a load to be moved along a path defined by a guide member or members, freely past support or attachment points for such guide member or members.

Such a load transfer device has many applications for example in the building, mining, quarrying, farming and engineering, including civil engineering industries. The device can satisfy many requirements for the safety, mobility and physical guidance of personnel and/or equipment at risk from falling, inadequate support or disorientation, for example while on buildings and structures or on sight diminished tasks such as underwater. It can be considered as an alternative device to those conventionally used on aerial ropeways and cable car systems or other systems where a load is moved along a track defined by an elongated member, which may be flexible, e.g. a wire or cable; or rigid, e.g. a rod or tube. It also finds similar application at harbors and docks where goods and people have to be moved from ship to shore and vice versa.

One particular problem which can occur with known prior art devices is complete detachment of the wire or cable from the recessed wheel assembly under twisting loads on the wire in a direction perpendicular to the plane of the wheel. This detachment is called "wind-out", and is caused by the wire engaging in a recess of the wheel and being "wound" past the guide structures as the wheel rotates relative thereto.

SUMMARY OF THE INVENTION

According to the present invention there is provided a load transfer device comprising a rotatable wheel which is formed with several recesses in its periphery, the recesses being evenly spaced around the wheel and adjacent recesses being separated by a projecting part of the wheel; and at least one guide member supported at a peripheral part of the wheel, the wheel and guide member having co-operating relatively rotatable surfaces and the arrangement being such that, when the load transfer device and a load bearing element, which extends transversely to the plane of the wheel and co-operates in use with the load transfer device, encounter one another, the wheel can rotate about its axis relative to the guide member with said element being received, guided and passed in one or a succession of the aforesaid recesses and being located with respect to the wheel by said guide member.

The wheel may be made of any suitable resilient material, for instance metal, such as stainless steel, or for lighter uses a plastics material may be adequate. Similarly its dimensions may vary considerably, depending on the use to which it is to be put, for instance from about 50 mm in diameter for use on a boat to about 400 mm for mining or heavy lift ropeways. It may be made as a single unit for instance by molding, or assembled from separately made parts. In some embodiments, the wheel and guide member may have interlocking male and female parts. In such embodiments there may be a peripheral groove or channel in which the guide member can be located. In such embodiments the wheel may comprise two circular discs separated by a central connecting core, each disc being cut away to form the several recesses. The projecting parts of each disc may have peripheral flanges which locate with corresponding grooves in the guide or vice versa.

The guide member may be curved to conform to the curvature of the peripheral part of the wheel. All corners and edges on the wheel and the guide member are preferably shaped and smoothed so as to reduce friction and facilitate the various motions which occur when the load transfer device is in use.

The shape of the recesses and projection parts of the wheel can be varied both in number and design but it has been found in practice that six U-shaped recesses, evenly spaced around the wheel, making six corresponding approximately triangular projecting parts, function satisfactorily. It has also been found in practice that wheels with three and four recesses function satisfactorily and that self-indexing of the wheel to the load-bearing element can be achieved by the shaping of the projecting parts. The factors to be considered when designing these parts of the wheel are the dimensions of both the wheel and the attaching means which is to be moved along or on the wire or other elongate member and the service required from the wire or elongate member. Each recess must be sufficiently large to accommodate the load attachment means as it moves along the wire or, in systems where the load is attached to the load transfer device, to accommodate supports for the elongate member or other load bearing elements which support the load transfer device as it moves with the load along a guideway or guidepath. As a load-attachment device or a load bearing element enters a recess it will cause the wheel to rotate, for which reason the wheel can be freely mounted on its shaft, and so enable the load attachment to move through the load transfer device, or the load transfer device to move past a fixed load bearing support location. Alternatively however the position of the wheel can be mechanically controlled to give the required alignments.

In these embodiments the dimensions of the flanges, or grooves, on the periphery of each projecting part may be such as to correspond with those of grooves, or flanges, provided on the sides of the guide member so that the latter will ride freely in the peripheral flanges, or grooves, of the wheel and yet will be securely located therein.

A load transfer device according to these embodiments could in some applications be spliced or connected into a length of wire or other elongate member by the attachment of two ends to diametrically opposite guide members of the load transfer device to allow another wire or elongate member to traverse the plane of the first such member.

In other embodiments the wheel may comprise a single disc having peripheral grooves near to its circumference and the guide member may have mating flanges, the guide member in this case being the outer component and being formed with a channel or similar passage to receive and locate a wire or other elongate member.

The wire guide in the wheel is also made of any material suitable for the use envisaged, for instance a metal or a plastics material and its dimensions preferably conform with those of the wheel since it is usually to be located either within the peripheral groove or channel formed by the flanged disc portions of the wheel or on the peripheral edge of the wheel. In the above mentioned embodiments in which the wheel has six recesses the guide member is advantageously long enough to span two adjacent projecting parts and their separating recess.

The guide may or may not have a longitudinal hole through it through which a wire or other elongate member is passed. If so the configuration of the hole is drawn to conform to the lead required of the wire or elongate member. The frictional surface presentation of this containment will also depend on the service required, i.e. a greater or lesser degree of slip or hold can be envisaged for varying conditions. In some situations however no longitudinal hole is required and the wire may pass through the load transfer device along a chord or the perimeter of the wheel. In such cases passage of the load past the guide may be assisted by the provision of a wheel or roller mounted on the guide in such a position that its perimeter is in contact with the wire as shown in FIGS. 7 and 8 of the drawings. Additionally where the frictional forces between the flanges and corresponding grooves require relief, for instance in heavy duty versions of the invention, bearing systems can be incorporated either on the flanges or within the grooves.

In further embodiments of the invention, there may be provided two spaced relatively rotatable discs having mating central portions providing a central connecting core, one disc being formed with said recesses and constituting said wheel and the other disc having said guide member formed integrally therewith and provided by a projection extending from a peripheral part of said other disc towards said one disc to locate an elongate support element between the guide member and said central core, said projection and said one disc having confronting surfaces which are relatively rotatable when said one disc rotates with said other disc stationary.

If desired a load transfer device according to the invention may support more than one wire, for instance two parallel wires may each be located in a guide in a single load transfer device and loads passed independently along both wires.

Each wheel is supported on an axle or shaft on which it can be rotated freely or in a controlled manner and such axle or shaft can in some applications be mounted directly or indirectly on to a supporting post or other rigid fixture. For instance each wheel can be mounted in a casing which carries the shaft in appropriate bearings and is in turn secured to the support. Such casings may be useful to prevent damage to the wheel itself, to prevent fouling by dust or debris and to increase safety.

Where the application of the invention requires a smooth, controlled operation, for instance, as in the case of a passenger-carrying cable car system, it would be necessary to control the movement of the wheel so as to ensure its exact positioning for the next operation. This would be done via a release/break mechanism mechanically actuated either by the passage of the load-securing device or the rotation of the wheel. In general however the alignment of the load transfer device for the indexing function is ensured by the designed shape of the projections on the wheel.

In use, a load transfer device according to the invention is secured to each intermediate support for the wire or other elongate member except in the case in which the load is actually suspended from a load transfer device according to the invention which itself moves along the wire or other elongate member and passes each attachment point therefore. The wire or elongate member is passed through the longitudinal hole in the guide in each wheel or between the guide and the center of the wheel and is made secure at each end. When a load, loosely attached to the wire by means of a ring, clip, pulley or other load-attachment means, so as to be slideable therealong moves along the wire and reaches the load transfer device the load attachment means will slide into one of the recesses in the wheel thereby causing it to rotate, thus exposing one end of the guide member. The load attachment means slides over the guide member as the wheel rotates and moves along the guide member until it reaches the other end and comes on to the elongate member once again, the guide member remaining in position along the elongate member within the peripheral groove of the wheel. Owing to the curvature of the peripheral parts and the smoothness of the surface, if the wheel is in such a position that the hook first contacts a projecting part instead of a recess, the wheel will immediately be rotated so that the load attachment means will slide into the next recess. This will generally apply in the case of a random or relatively uncontrolled load attachment means. Where a more precise passage of the load attachment means through the device is required, as already mentioned a mechanical control of the wheel can be incorporated to ensure favorable alignment of the load attachment means to the recesses.

In a similar way the load will pass the attachment points if the load is attached to a moving elongate member passing through the load transfer device or if the load is suspended from a load transfer device according to the invention which itself moves along and elongate member.

It has been found in practice that the load transfer device operates successfully in either direction.

BRIEF DESCRIPTION OF THE DRAWINGS

FIGS. 8A and 8B show a load suspended from a load transfer device according to the invention;

FIGS. 9 and 10 show an embodiment in which the wheel comprises a single disc;

In FIGS. 1 to 6 of the drawings a wheel 1 of a load transfer device embodying the invention, is made up of discs 2 and 3 with a central core 4 through which a hole 5 passes. Each disc has six U-shaped recesses 6 and corresponding triangular projecting parts 7 and each projecting part has a flange 8. A wire guide or slug 9 is grooved to fit flanges 8 as shown and has a longitudinal hole 10 through which a wire 11 is passed. In FIGS. 5 and 6 a casing 12 is shown provided with bearings 13 for the shaft on which the wheel is mounted, and a bracket 14 for attaching the load transfer device to a post, stanchion or other support.

Figure 1:
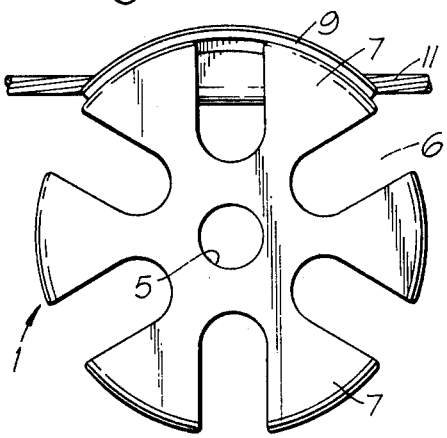
FIG. 1 is a side view of a wheel and guide according to the invention.
Figure 2:
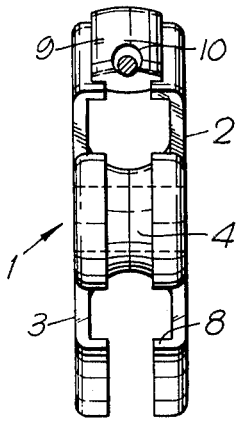
FIG. 2 shows an end view of the same.
Figure 3:
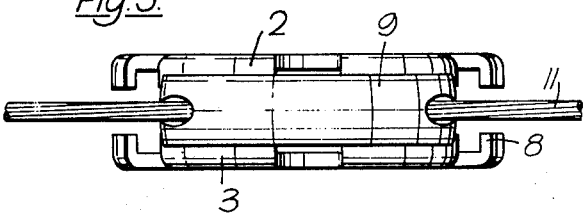
FIGS. 3 and 4, show a plan and sectional view respectively.
Figure 4:
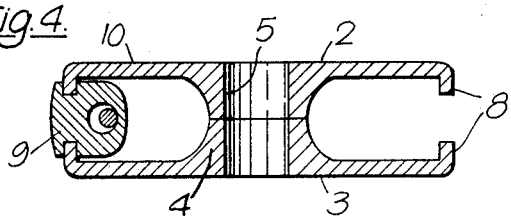
Figure 5:
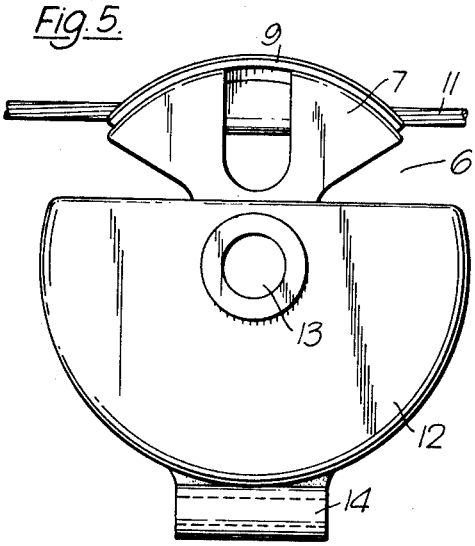
FIGS. 5 and 6 show side and end views respectively, of a wheel and guide located in a protective casing.
Figure 6:
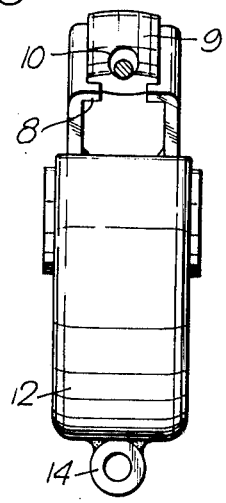

In use when a load attachment means slides from right to left (with reference to FIG. 1) along wire 11 it moves into recess 6 in wheel 1. In doing so it comes into contact with projecting part 7 of the wheel and causes the wheel to rotate in a counter-clockwise direction. As it does so part 7 moves away from the right hand end of guide or slug 9 and the load attachment means slides on to guide 9. It is moved over and along the guide by the pull of the load. When part 7 clears the left hand end of the guide the load attachment means moves on the wire from the guide and the wheel is ready for the next traversing operation.

Figure 7A:
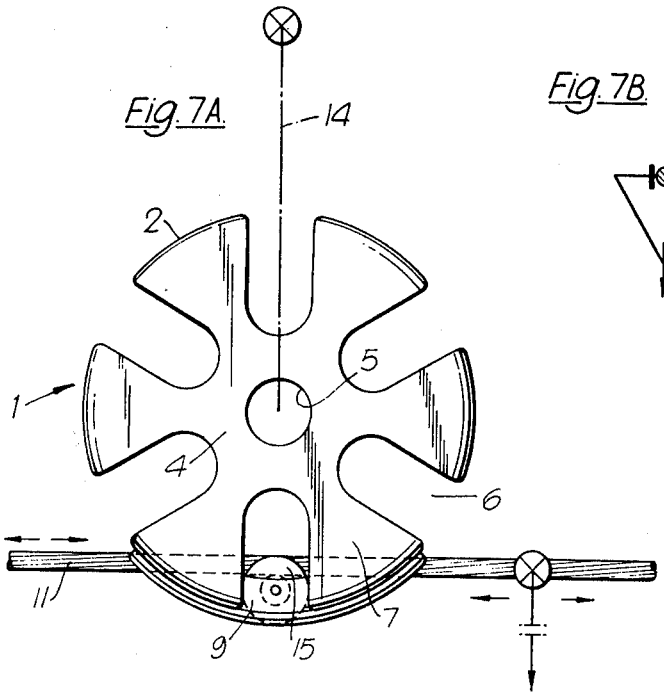
FIGS. 7A and 7B show a load attached to a running wire supported by a load transfer device embodying the invention.
Figure 7B:
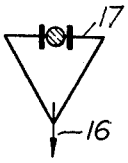

In FIGS. 7 and 8 the guide 9 is shown with a freely running wheel or roller 15. In FIG. 7B the load 16 is carried on a yoke 17 as shown, while in FIG. 8 the load 16 is suspended from the center axle 18 of the wheel, and in this case the wire attachment point is shown in section at 19 in FIG. 8B.

Figure 10:
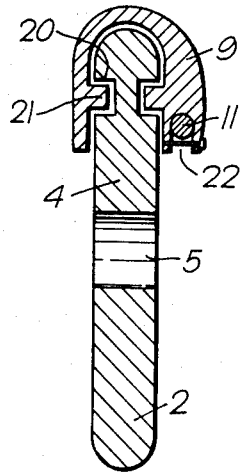

In FIGS. 9 and 10 the wheel has a single disc 2 having peripheral grooves 20 and the wire guide 9 has corresponding flanges 21. The wire 11 is located in a channel 22 in the guide.

Figure 11:
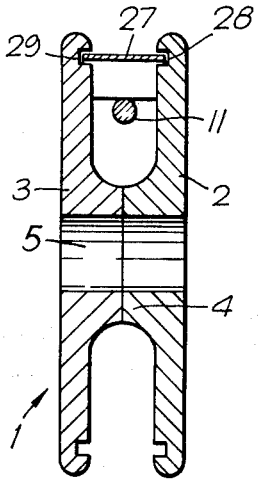
FIG. 11 shows a section through another embodiment.

In FIG. 11 the wire guide 9 is provided by a curved plate-like part 27, e.g. a segment from the wall of a tube, having opposite edge regions received in circumferentially extending grooves 28 and 29 in the projecting parts of the discs 2 and 3 forming the wheel 1. The wire 11 engages the opposite axially extending ends of the part 27.

Figure 12:
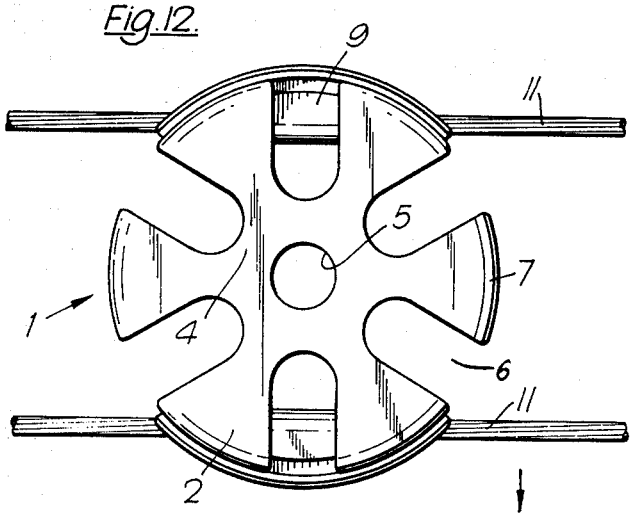
FIG. 12 shows a load transfer device and two parallel wires.

In FIG. 12 a latchway 1 carries two wire guides 9 in each of which a wire 11 is located.

Figure 13:
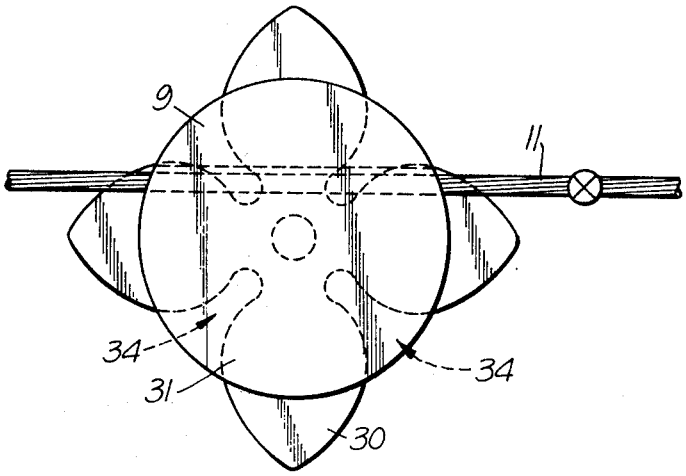
FIGS. 13 and 14 show respectively a front and side view of a further embodiment.
Figure 14:
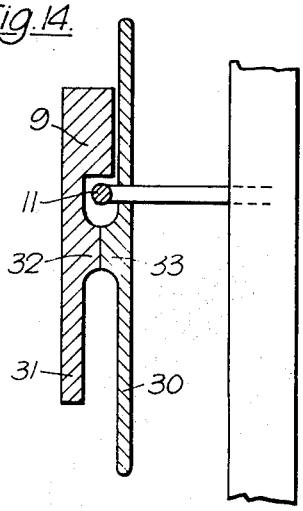

FIGS. 13 and 14 show a further embodiment in which the wheel comprises a disc 30 which is provided with a co-operating disc 31. The discs are shafted together at central mating bosses 32, 33 thereof such that the disc 30 can rotate relative to the disc 31. Disc 30 is generally cruciform having four radial projections defining therebetween four equiangularly spaced recesses 34. A wire guide 9 is provided in the form of a segment shaped projection from disc 31 which extends towards disc 30, there being confronting surfaces on the guide 9 and disc 30 which rotate relative to one another when disc 30 rotates in use with disc 32 stationary. A wire, rod or tubular element 11 forming a guide track is suspended from a fixed structure by a series of supports at spaced locations along the elongate member 11. The member 11 extends through the load transfer device in the space between the guide 9 and the central core provided by mating bosses 32 and 33. In use a load is suspended from the load transfer device so that it is movable along the guide track provided by member 11. When the load transfer device encounters a support, the support is received, guided and passed in one of the recesses 34. At such times the wheel 30 rotates whereas the disc 31 at all times during motion along member 11 slides without rotation.

In embodiments of the invention described above where the load transfer device is at a stationary location and an elongate member extends through the latchway, the guide member may be shaped to effect a change of direction of the elongate member as it passes through the load transfer device.

What is claimed is:

1. A system for enabling a load to be moved along a guide path comprising:

(a) a pair of wheels, at least one being formed with several recesses evenly spaced around its periphery, the recesses being spaced by projecting parts of the wheel;

(b) a slug member shaped to generally conform to, and located between, juxtaposed peripheral parts of the wheels to allow relative rotation between at least one of the wheels and the slug member;

(c) an elongate guide member defining the aforesaid guide path and extending between the wheels as a chord across the wheels at peripheral parts thereof;

(d) means to maintain the elongate member in sliding contact with the slug member to permit relative movement between the wheel and slug member assembly and the elongate member while locating the elongate member with respect to the wheel and slug member assembly;

(e) rigidly fixed support means supporting one of the group consisting of said wheel and said elongate member; and (f) load attachment means associated with the other of the group consisting of said wheel and said elongate member.

2. A system as claimed in claim 1 wherein said recesses in said wheel have substantially parallel side edges.

3. A system as claimed in claim 1 wherein the slug member has a longitudinal hole through which the elongate member passes.

4. A system as claimed in claim 1 wherein the wheel and slug member have interlocking male and female parts.

5. A system as claimed in claim 4 wherein the wheels comprise two discs separated by a central connecting core and each disc is cut away to form the several recesses, and wherein the projecting parts of each disc and the slug member have mating flanges and grooves extending in the circumferential direction of the wheels.

6. A system as claimed in claim 5 wherein the slug member is provided by a curved plate-like part having opposite edge regions providing flanges which slidingly engage in corresponding grooves provided in the projecting parts of the discs.

7. A system as claimed in claim 1 wherein on the slug member at least one free-running rolling element is mounted with its perimeter contacting the elongate member.

8. A system as claimed in claim 1 wherein two slug members are provided at diametrically opposite locations of the wheels for locating two elongate members with respect to the wheels.

9. A system for enabling a load to be moved along a guide path comprising:

(a) a wheel having several recesses formed at evenly spaced positions around the periphery of the wheel, the recesses being spaced by projecting parts of the wheel;

(b) a slug member bridging a peripheral part of the wheel and shaped to generally conform thereto;

(c) interengaging circumferentially extending flanges and corresponding recesses provided on said projecting parts of the wheel and on the slug member to locate the slug member on the wheel while allowing rotation of the wheel relative to the slug member;

(d) an elongate member defining the aforesaid guide path and extending as a chord across the wheel at peripheral parts of a plurality of said projecting parts thereof;

(e) means to maintain the elongate member in sliding contact with the slug member to permit relative movement between the wheel and slug member assembly, and the elongate member;

(f) rigidly fixed support means supporting said wheel; and (g) load attachment means slidingly engaged with said elongate member.

10. A system as claimed in claim 9 wherein the elongate member is located in a channel in the slug member.

11. A system for enabling a load to be moved along a guide path comprising:

(a) a pair of wheels;

(b) a slug member shaped to generally conform to, and located between, juxtaposed peripheral parts of the wheels to allow relative rotation between at least one of the wheels and the slug member;

(c) an elongate member defining said guide path and extending between the wheels as a chord across the wheels at a peripheral part thereof and in sliding contact with the slug member to permit relative movement between the wheel and slug member assembly and the elongate member;

(d) a series of recesses evenly spaced around the periphery of at least one of the wheels to receive and pass attachement means associated with the elongate member, and being separated by projecting parts of the wheel, the recesses having a width not substantially greater than the transverse dimension of said elongate member to resist engagement of the elongate member in such recesses under twisting loads thereon in a direction at right angles to the plane containing the recessed wheel, and consequential detachment of the elongate member from the wheel and slug member assembly during further rotation of the recessed wheel relative to the slug member;

(e) rigidly fixed support means supporting said elongate member; and (f) load attachment means secured to said wheel.

12. A system as claimed in claim 11 wherein the wheels comprise two spaced relatively rotatable discs having central mating portions providing a central connecting core, one disc being formed with said recesses and the other disc having said slug member formed integrally therewith and provided by a projection extending from a peripheral part of said other disc towards said one disc to locate the elongate member between the slug member and said central core, said projection and said one disc having confronting surfaces which are relatively rotatable when said one disc rotates with said other disc stationary.

13. A system as claimed in claim 12 wherein the tip portions of each of said projecting parts of the wheel are rounded to converge to a point at the extremity of each projecting part whereby rotation of the wheel will take place in any angular position thereof when engaged by transverse members associated with the elongate member to provide self-indexing of the wheel during use of the system.

14. A system as claimed in claim 12 wherein said projection has the form of a stationary segment of a circle defining the periphery of the stationary disc.

15. A system as claimed in claim 12 wherein the slug member is sized and shaped to have a sliding surface in sliding contact with the elongate member to locate such member at a position, when viewed in the axial direction of the recessed wheel, sufficiently towards the base of any recess whereby the recessed wheel will be prevented from rotating to allow complete disengagement of the elongate member from the wheel assembly on initial engagement of the elongate member in one of said recesses due to a twisting load on the elongate member.

16. A system for enabling a load to be moved along a guide path comprising:

(a) a pair of spaced wheels, at least one of which has several recesses formed at evenly spaced positions around its periphery, the recesses being spaced by projecting parts of the wheel;

(b) an elongate member defining said guide path and extending between the wheels as a chord across the wheels;

(c) a slug member shaped to generally conform to, and located between, juxtaposed peripheral parts of the wheels and the slug member being sized and shaped to have a sliding surface in sliding contact with the elongate member to locate such member at a position, when viewed in the axial direction of the recessed wheel, sufficiently towards the base of any recess whereby the recessed wheel will be prevented from rotating to allow complete disengagement of the elongate member from the wheel assembly on engagement of the elongate member in any recess during rotation of the wheel as a result of twisting loads on the elongate member in a direction perpendicular to the plane containing the recessed wheel;

(d) rigidly fixed support means supporting said elongate member; and, (e) load attachment means secured to said wheel.

* * * * *